US006129383A

United States Patent [19]

Kocher, Jr.

[11] Patent Number: 6,129,383

[45] Date of Patent: Oct. 10, 2000

[54] VEHICLE BODY ARMOR SUPPORT SYSTEM (V-BASS)

[76] Inventor: Robert William Kocher, Jr., P.O. Box 4613, Troy, Mich. 48099

[21] Appl. No.: 09/113,516

[22] Filed: Jul. 10, 1998

Related U.S. Application Data

[60] Provisional application No. 60/070,230, Dec. 31, 1997.

[51] Int. Cl.[7] ..... B60R 21/02

[52] U.S. Cl. ..... 280/748; 280/751; 297/464; 297/465

[58] Field of Search ..... 280/748, 751; 297/464, 465

[56] References Cited

U.S. PATENT DOCUMENTS 4,834,322 5/1989 Wurst ..... 244/122 AG
5,301,903 4/1994 Aronne ..... 244/122 AG

*Primary Examiner*—Eric Culbreth
*Assistant Examiner*—L. Lum

[57] ABSTRACT

The Vehicle Body Armor Support System (V-BASS) significantly enhances the survivability of vehicle crewmembers and occupants in aircraft and ground vehicles from high velocity projectiles such as shrapnel or bullets at minimum weight burden on the vehicle occupants. Current heavy body armor systems weigh 20 to 40 pounds. The majority of this weight is carried on the vehicle occupant's torso and transferred through the occupant's spine to the seat. The Vehicle Body Armor Support System invention allows the direct transfer of the heavy body armor system's weight directly to the seat without burdening the occupant. This invention is comprised of a vehicle platform; an occupant seat supported by the vehicle platform; an occupant armor component carried on the occupant and a support strut configured to be connected between the armored component and the occupant seat to transfer the weight of the armored component from the occupant to the seat.

9 Claims, 4 Drawing Sheets

VEHICLE BODY ARMOR SUPPORT SYSTEM (V-BASS)

RELATED APPLICAITON

This application claims the benefit of U.S. Provisional application Ser. No. 60/070,230, filed Dec. 31, 1997.

BACKGROUND OF INVENTION

Protecting crewmembers and occupants of aircraft and ground vehicles (hereinafter referred to as vehicle occupants) from high velocity projectiles such as shrapnel or bullets has traditionally involved expensive options. Vehicle occupants are extremely vulnerable from small arms, anti-aircraft fire or landmines. Since armor is relatively heavy, armoring large sections of aircraft becomes weight prohibitive. Ground vehicle occupants such as trucks, jeeps, or cars are in a similar situation therefore can utilize similar vest approaches found on aircraft. Heavy vests are feasible solutions since the vehicle occupants are normally seated and engage in limited activity. The problem with the heavy body armor arises during extended wear or over rough raveling conditions. The body armor's additional weight bears down on the wearer's spine, causes rubbing on the wearer's back and chest, and if worn loosely, can impact on the wearer's upper thighs. During severe bumps, hard landings, or traveling over rough terrain, the increased body armor weight could contribute to serious spine injuries or death.

REFERENCE NUMERALS IN DRAWING

Item 1 is the ballistic material carrier

Item 2 is the ballistic front plate

Item 4 is the ocupant's upper thigh

Item 5 upper support strut attachment

Item 6 is the support strut

Item 7 is the support strut base that interfaces with the seat

Item 8 is the support strut adjusting mechanism

Item 9 is a attaching pin

Item 10 side support struts

Item 12 is a side base support two support struts

Item 13 is a vehicle seat

Item 14 is a groin armor plate

Item 15 is a back plate

Item 16 is armor carrier

Item 17 is a side armor plate

DESCRIPTION OF PREFERRED EMBODYMENTS a. The Single Leg Support Strut (SLS)

Figure 1:
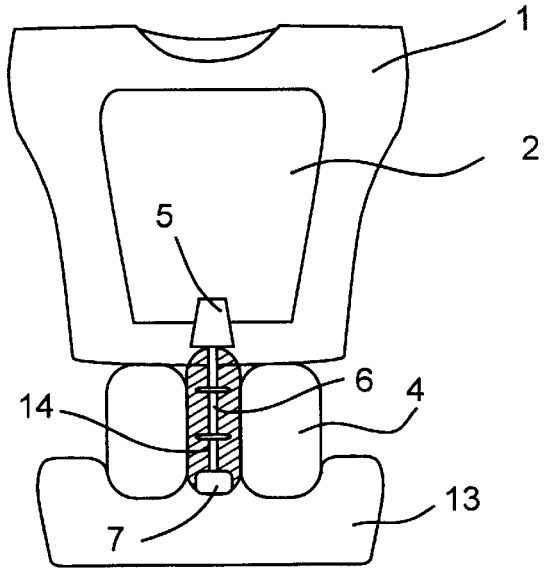
FIG. 1 Front view of seated occupant
Figure 2:
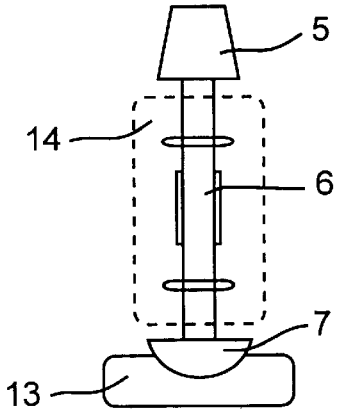
FIG. 2 Front view of support strut
Figure 3:
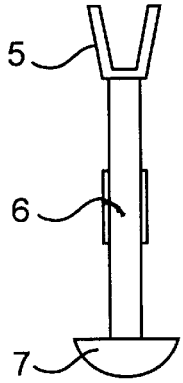
FIG. 3 Side view of support strut
Figure 4:
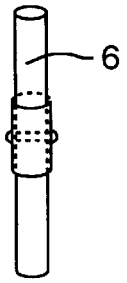
FIG. 4 Pin type expander of support strut
Figure 5:
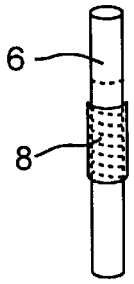
FIG. 5 Screw type expander of support strut
Figure 6:
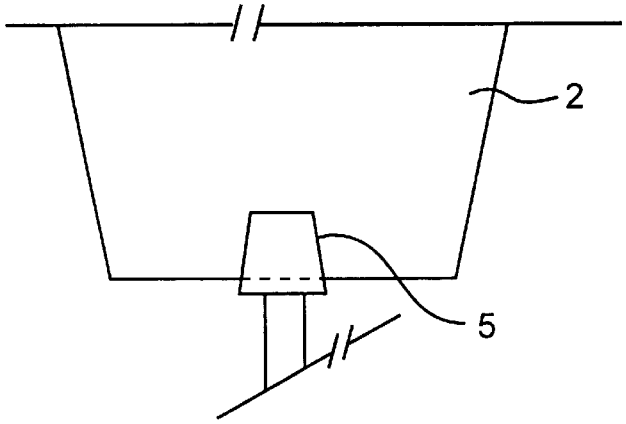
FIG. 6 Front view of upper strut and front plate interface
Figure 7:
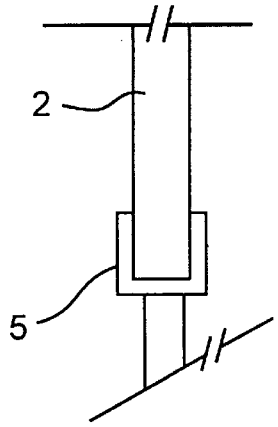
FIG. 7 Side view of upper strut and front plate interface
Figure 8:
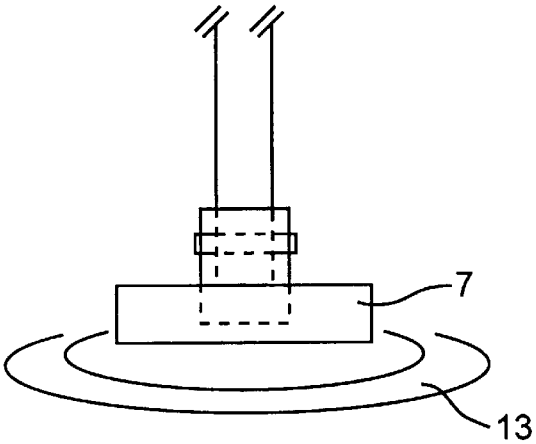
FIG. 8 Front view of base pivot joint
Figure 9:
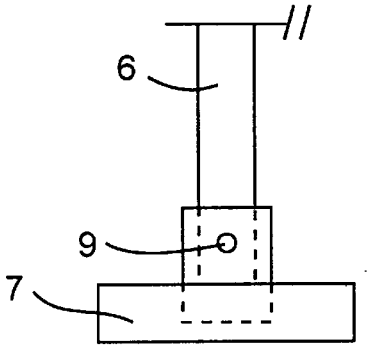
FIG. 9 Side view of base pivot joint

FIG. 1 shows a chest plate vest configuration and is a front view of an air/ground vehicle occupant seated in the vehicle seat 13. Item 4 is the occupant's upper thighs. The basic material carrier 1 is worn by the occupant and bears the load of the armor system when the vehicle occupant is standing or outside of the vehicle. Item 2 represents the hard armor ford plate. Item 3 is the support strut device transferring the majority of the front plate's weight to the seat. FIGS. 2 and 3 are front and side views of the SLS device. The SLS consists of 3 components with an optional armor piece 14, can protect the groin area from fragments. The upper component of the support strut 5 attaches to the vest 1 or chest plate 2. The strut upper support attachment 5 can have an adjustable screw or adjusting device that can change the width of the opening to attach to the vest 1 or chest plate 2. For various versions of chest armor, a quick release type material such as a hook-and-loop connection can keep the strut upper attachment 5 attached to the vest 1 or the support strut 6 could be built into the vest 1. FIGS. 4 and 5 depict an example of an adjustable support shaft 6 that connects the upper strut attachment 5 to the strut seat support 7. The strut seat support 7 is designed to rest on the seat 13, and distribute the vest's weight over several square inches thereby not damaging the seat and moving up and down at the same rate as the person sitting in the seat. If the user desired to prevent the support shaft base 7 from moving around on the seat 13, a hook-and-loop tape can be used to allow quick connection and disconnection. The support strut 6 can employ various adjusting mechanisms such as a pin type shown in FIG. 4 or FIG. 5 shows a screw type expander 8. FIGS. 6 and 7 show a more detailed front and side view of the upper portion of the support strut 5, connecting to the front plate 2. FIGS. 8 and 9 shows a front view and side view of a pivoting joint where by the support strut shaft 6 is connected to the seat foot 7. A small piece of armor 14 can be added perpendicular to the support strut base 7 and attached to the support strut 6, which would provide groin protection from fragments, if desired as shown in FIG. 2.

b. Double Leg Support Strut Side Mounted (DLS)

Figure 10:
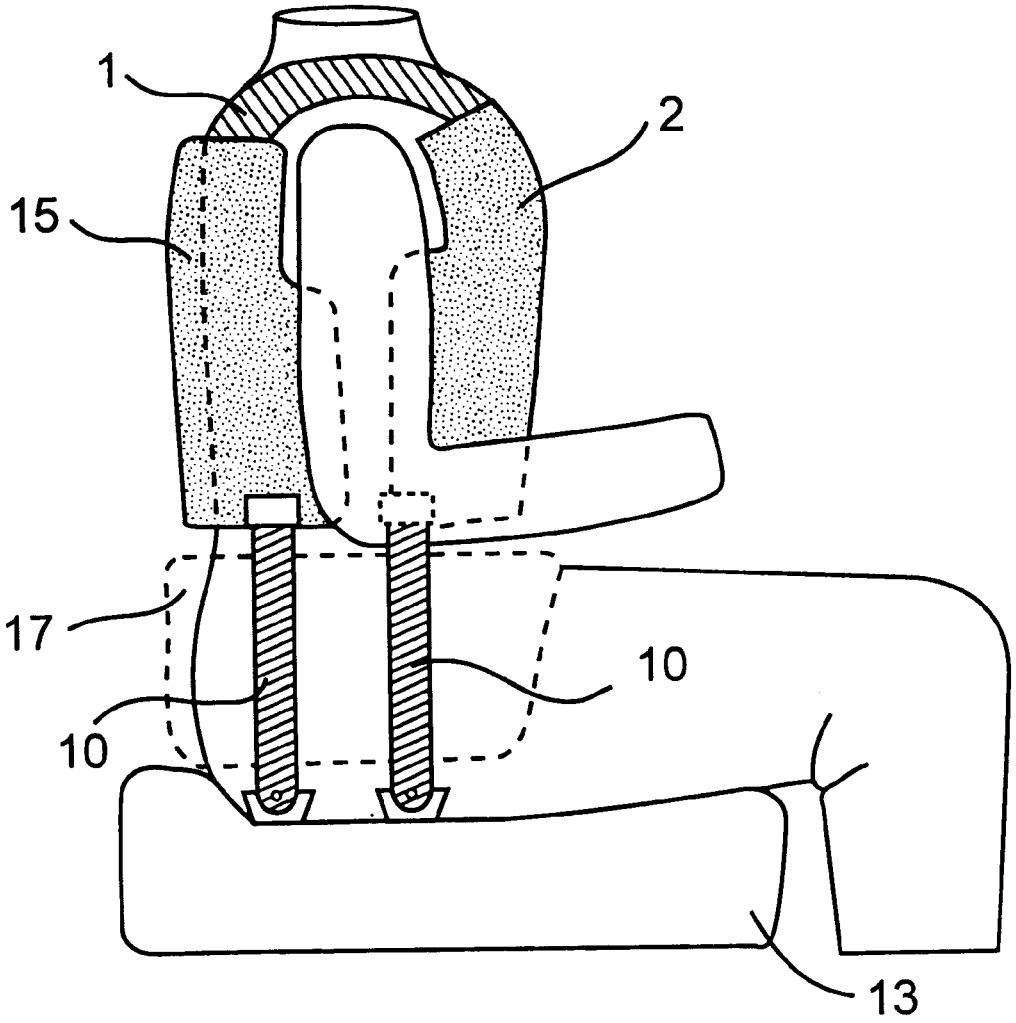
FIG. 10 Side view of vehicle occupant

The double leg support strut, DLS, is similar to the single leg strut, SLS, except the DLS is mounted on the side of the vehicle occupant. This configuration may be desired when the pilot is required to move in such a manner that the SLS would be awkward. FIG. 10 shows a side view of the vehicle occupant with the double leg support system supporting the occupant's armor on the right side. Items 10 are the two support struts. Item 2 is the front plate, Item 15 is a back plate. Both front 2 and back plates 15 can be manufactured to provide more coverage than traditional body armors since the threat angles include the sides of the wearer. FIG. 10 shows the front 2 and back plates 15 wrapping underneath the vehicle occupant's arms. Item 1 is the armor system carrier worn by the vehicle occupant and supports the armor system when the occupant is standing or is out of the vehicle. Item 17 is an optional armor plate that can be attached to the support struts 10 or suspended from the armor system 15 and/or 2 to provide lower hip protection from ballistic threats from the side. The rear portion of the DLS attached to the back plate 15 could be used in conjunction with the SLS. FIG. 10 shows the DLS with similar components, as the SLS except that the adjustable support shaft 10 is longer than the adjustable support shaft 6 of FIG. 1. The support shaft 10 is connected at an angle to go around the thigh. The support shaft 10 is also adjustable and extends from the back plate 15 to the seat foot 12 and rests on the vehicle seat 13.

c. 'Vee" Leg Support Strut, Side Mounted (VLS)

Figure 11:
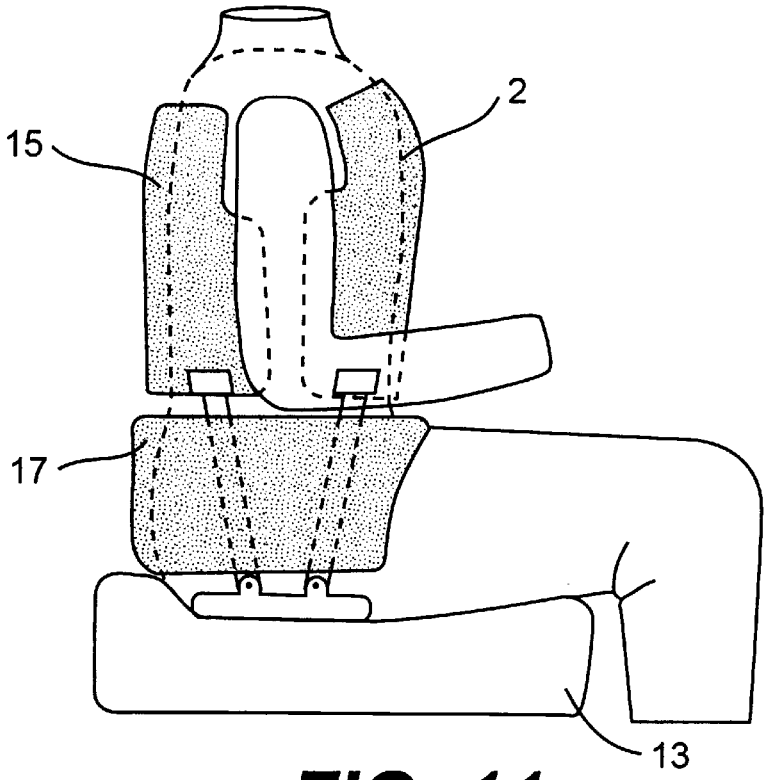
FIG. 11 Side view of vehicle occupant with DLS
Figure 12:
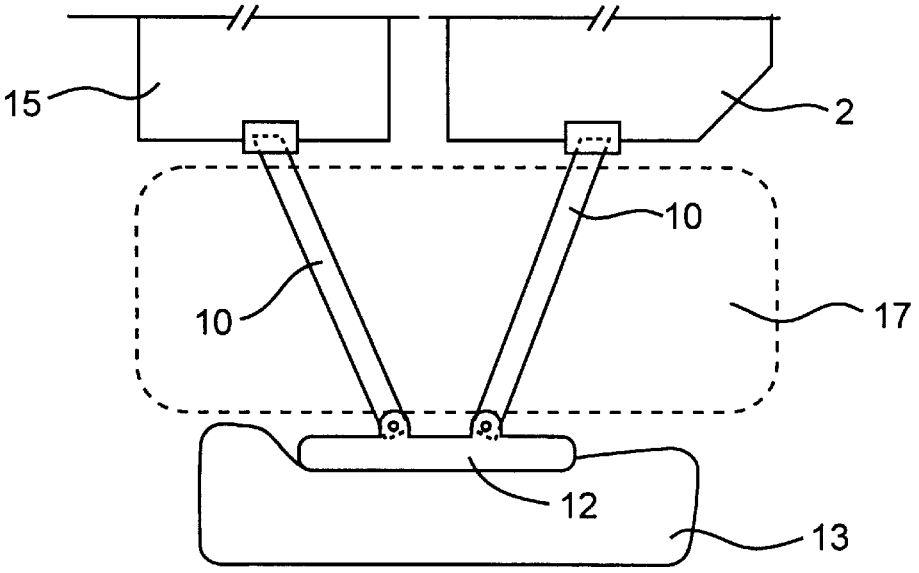
FIG. 12 Side view of vehicle occupant with VLS

The VLS is similar to the DLS except that the two adjustable legs 10, shown in FIG. 11 and FIG. 12, are connected at a common base 12. This common base of foot, 12 transfers the weight of the armor system's heavy plates,2 and 15, to the vehicle seat 13. An armored plate 17 can be added to the support strut base 12 and connected to the support struts 10 in such a manner to provide ballistic protection to the crewman's upper thigh. The same configuration exists for the vehicle crewman's left side, This configuration is still functional when the crewman stands up and walks around.

What is claimed is:

1. An arrangement comprising at least one support strut supporting an armored vest worn by an occupant in a vehicle, having a base, an upper component, and a shaft connecting the base and upper component, wherein the upper component, is connected to the armored vest, and the base is supported on a seat, such that the support strut transfers weight of the armored vest to the seat.

2. The arrangement of claim 1 comprising front and back plates of the armored vest, each plate extending towards a side, and an underarm area, of the occupant, and a pair of support struts for each plate, wherein each strut is placed at each side of the occupant.

3. The arrangement of claim 1 comprising front and back plates of the armored vest, each plate extending towards a side, and an underarm area, of the occupant, and a support strut including two shafts, the shafts arranged in a V-shaped configuration, wherein the strut is placed at each side of the occupant, and, each shaft supports an edge of each plate.

4. The arrangement of claim 1 comprising an armored plate attached to the support strut, and placed between the occupant's legs for protecting a groin area.

5. The arrangement of claim 2 comprising an armored plate attached to the support struts, and situated on the side, and lower hip area, of the occupant.

6. The arrangement of claim 3 comprising an armored plate attached to the support strut and situated on the side, and lower hip area, of the occupant.

7. The arrangement of claim 1 including a height adjusting mechanism in the shaft.

8. The height adjusting mechanism of claim 7 includes a pin, or a two piece screw expander.

9. The arrangement of claim 1 including a pivot mechanism between the shaft and base.

* * * * *